United States Patent [19]

Bretthauer et al.

[11] Patent Number: 4,459,697

[45] Date of Patent: Jul. 10, 1984

[54] ELECTRODE ARRANGEMENT FOR ELECTRIC ARC FURNACES

[75] Inventors: Karlheinz Bretthauer, Clausthal-Zellerfeld; Werner Höke, Hanover; Günter Meyer, Essen, all of Fed. Rep. of Germany

[73] Assignee: Fried. Krupp Gesellschaft mit beschränkter Haftung, Essen, Fed. Rep. of Germany

[21] Appl. No.: 343,291

[22] Filed: Jan. 27, 1982

[30] Foreign Application Priority Data

Jan. 30, 1981 [DE] Fed. Rep. of Germany ..... 3103044

[51] Int. Cl.[3] ..... H05B 7/144

[52] U.S. Cl. ..... 373/102

[58] Field of Search ..... 373/101, 102, 103, 104, 373/108, 94, 60

[56] References Cited

U.S. PATENT DOCUMENTS 654,463 7/1900 Leleux ..... 373/101
919,165 4/1909 Harrison ..... 373/102 X

FOREIGN PATENT DOCUMENTS 1294386 10/1972 United Kingdom .
1389906 4/1975 United Kingdom .
1508691 4/1978 United Kingdom .
358656 10/1981 United Kingdom .

*Primary Examiner*—Roy N. Envall, Jr.
*Attorney, Agent, or Firm*—Spencer & Frank

[57] ABSTRACT

In order to assure a high arc current and a high arc power with simultaneous reduction of flicker voltages, at least two juxtaposed electrodes, each having the same distance from the vertical axis of the furnace and the same electrical potential, are connected to each phase of an electric arc furnace, which is preferably a three-phase electric arc furnace. Preferably circular electrodes are employed which are conductively connected together at least in the vicinity of the electric arc.

8 Claims, 5 Drawing Figures

FIG. 3a
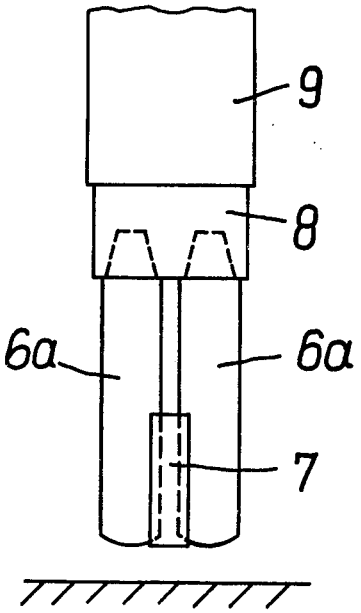
FIG. 3b
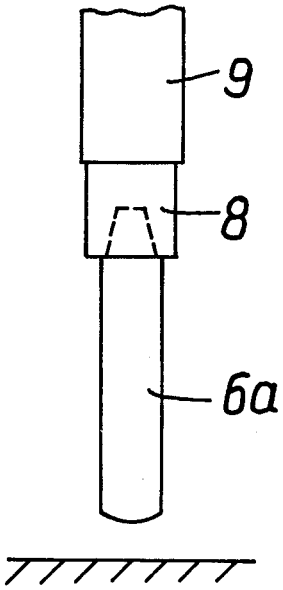
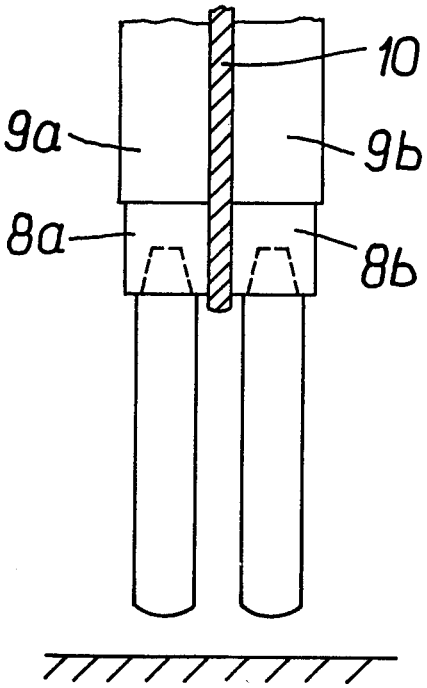
FIG. 4

ELECTRODE ARRANGEMENT FOR ELECTRIC ARC FURNACES

BACKGROUND OF THE INVENTION

The present application relates to an electrode arrangement for high power electric arc furnaces. Such furnaces are employed particularly in the manufacture of steel and are preferably operated with three-phase current.

An electric arc furnace is known to have a nonlinear current/voltage characteristic. With an electrode which is burning steadily and under constant operating conditions, the frontal face under which the arc burns has a distinctly defined outline which remains unchanged even while the electrode burns down. Since the consumption of the frontal face is caused essentially by the fact that the sublimation temperature of graphite is exceeded in the area of the base of the arc, the conclusion can be drawn that every point of the frontal face is under stress, on the average, approximately for the same time. The outline of the frontal face ascends toward the outside with reference; to the center of the furnace, so that the length of the arc is shorter in the center of the furnace than the corresponding length at the outside. Moreover, the equilibrium of the electromagnetic forces attacking the arc causes the arc to slope further toward the outside in the outer positions, i.e. to be additionally extended there.

With current intensities in the order of magnitude of $10^4$ A and more, the voltage requirement of an electric arc depends essentially only on the length of the arc. Since the different arc lengths at different times require different arc voltages, maintaining the frontal face contour inevitably leads to irregular amplitude fluctuations in the arc current which, due to corresponding voltage drops in the supplying network, result in voltage fluctuations, also called flicker voltages.

In the desire to increase the power of electric arc furnaces, the arc current, rather than the voltage, is increased in order to obtain a relatively short arc and thus a better power yield. For this purpose, experiments have been made with graphite electrodes which has a diameter up to 70 cm. However, it was found that difficulties arose if the diameters were more than 60 cm.

SUMMARY OF THE INVENTION

It is therefore the object of the present invention to provide an electrode arrangement which assures the highest possible arc current, and thus a high arc power, and which simultaneously reduces the flicker voltages.

This is accomplished in that in an electric arc furnace including a furnace body, a source of electrical power and a respective arc electrode connected to each phase of the source of power and mounted within the furnace body, at least two juxtaposed electrodes having the same electrical potential are connected to each phase of the source of power with each electrode being at the same distance from the vertical axis of the furnace body.

Since it is necessary to reset the electrodes once they have burned off and since fitting with conical threads has been found acceptable in practice, it is advantageous to employ circular electrodes, a preferred embodiment providing that two of these electrodes are connected to each respective phase. In principle, this is nothing other than that the cross section through which current flows in the prior art circular electrode having a diameter of 70 cm is divided into two electrodes so that the same current carrying capability can be realized with two circular electrodes which are connected to a respective phase and which each have a diameter of about 50 cm. Assuming the same current density, this yields an increase in current of about 40% compared to a single electrode having a diameter of 60 cm. At the same time the region in which the position can vary with respect to the radius of the furnace is advantageously reduced, so that changes in current amplitudes, and thus in the flicker load, of the network mains are reduced.

Advantageously, graphite electrodes are employed which are conductively connected together at least in the vicinity of the arc. The conductive connection is advisably made with the aid of a self-sintering, stamped carbon mass or the like disposed between two adjacent electrodes. With the above-described arrangement it is assured that the required uniform electrode consumption is considerably improved.

According to a further embodiment of the invention it is also possible to mount the juxtaposed electrodes of one phase so that they are insulated from one another, and to feed each one of the juxtaposed electrodes with current through a respective insulated lead. According to this arrangement, there result two parallel burning arcs of identical current intensity.

BRIEF DESCRIPTION OF THE DRAWINGS

FIGS. 3*a* and 3*b* are side view views of the electrodes according to FIG. 2, which are conductively connected together, as seen in the radial direction (FIG. 3*a*) and in the tangential direction (FIG. 3*b*).

FIG. 4 shows an electrically divided electrode mount.

DETAILED DESCRIPTION OF THE PREFERRED EMBODIMENTS

Figure 1:
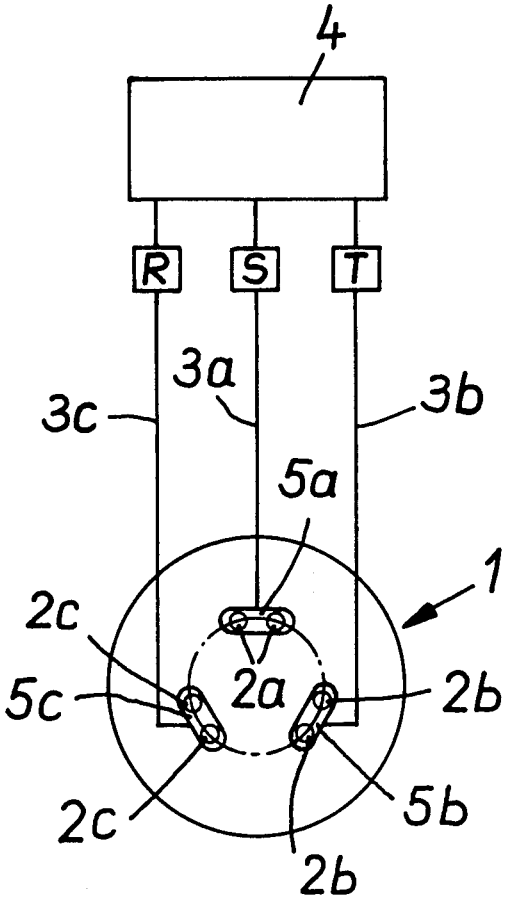
FIG. 1 is a schematic plan view of an electrode arrangement according to the invention in an electric arc furnace with the corresponding leads.

Referring to FIG. 1, there is shown an electric arc furnace including a vertical furnace body 1 having three pairs of electrodes 2*a*, 2*b* and 2*c* mounted therein. The electrodes of each pair of electrodes 2*a*, 2*b* and 2*c* are connected together, at least adjacent the arc, and via a respective high current line 3*a*, 3*b* or 3*c*, with the mains phases S, T and R of a three-phase network at the low voltage side of a furnace transformer 4. Although a three-phase source of electrical power as shown is preferred, a source of power with any number of phases may be utilized. Each of the electrode pairs 2*a*, 2*b* and 2*c* is arranged in an electrode mount 5*a*, 5*b* and 5*c* respectively such that each one of the electrodes is disposed within the furnace body 1 at the same radial distance from the vertical axis or center of the furnace body 1.

Figure 2:
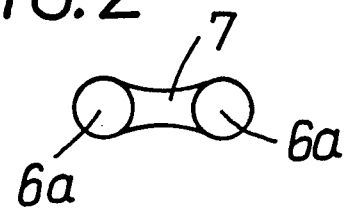
FIG. 2 is a top view of a pair of electrodes according to the invention which are connected to one phase and conductively connected together.

FIG. 2 shows a pair of electrodes which may be used for the respective electrode pairs 2*a*, 2*b* and 2*c* of FIG. 1. The electrode pair shown in FIG. 2 comprises the two circular electrodes 6*a*, which are conductively connected together via a conductive, self-sintering stamped carbon mass 7 disposed therebetween and preferably extending along the entire length of the electrode pair. The advantage of this arrangement is that only one lead, such as lead 3*a*, 3*b* or 3*c* of FIG. 1, is required per electrode pair.

Instead of the arrangement of FIG. 2, it is also possible to mount the respective electrodes of each pair in a mount so that they are insulated from one another, and to divide the leads for each phase into two halves. These respective lead halves are then brought to the two electrodes of such an electrode pair so that the leads, as well as the electrodes of each phase are insulated from one another.

The radial side view according to FIG. 3*a* shows the two electrodes 6*a* which are conductively connected together, at least adjacent to the arc, via a self-sintering stamped carbon mass 7. The electrodes are set in the mount 8 which in turn is joined to the support bar 9. In the tangential side view according to FIG. 3*b*, the two electrodes are shown disposed one behind the other, covering each other.

FIG. 4 shows the electrode arrangement of one phase seen in the radial direction, in which both the mount 8 and the support bar 9 are divided into two halves 8*a* and 8*b* and 9*a* and 9*b*, respectively which are separated from each other by an interposed layer 10 of insulating material, such that the current is fed to each electrode via its own current path.

It is understood that the above description of the present invention is susceptible to various modifications, changes and adaptations, and the same are intended to be comprehended within the meaning and range of equivalents of the appended claims.

What is claimed is:

1. In an electric arc furnace including a furnace body, a three-phase source of electrical power, and a plurality of arc electrodes mounted within said furnace body, with each phase of said source of power being connected to respective said arc electrodes; the improvement wherein at least two of said arc electrodes are connected to each said electrical phase so that they have the same applied electrical potential, and with each of said at least two arc electrodes being juxtaposed and being disposed at the same distance from the vertical axis of said furnace body.

2. An electric arc furnace as defined in claim 1 wherein each said phase is connected to two circular electrodes.

3. An electric arc furnace as defined in claim 1, or 2 wherein all of said electrodes which are connected to one said phase are conductively connected to one another.

4. An electric arc furnace as defined in claim 2 wherein all of said electrodes which are connected to one said phase are graphite electrodes, and wherein means are provided for conductively connecting all of said graphite electrodes which are connected to one said phase to one another at least in the vicinity of the arc, said means for conductively connecting including a self-sintering, stamped carbon mass disposed between adjacent said graphite electrodes.

5. An electric arc furnace as defined in claim 4 wherein said stamped carbon mass, and the resulting connection, extend over the entire length of the associated said electrodes.

6. An electric arc furnace as defined in claims 1 or 2 wherein the plurality of said electrodes which are connected to each phase are mounted in said furnace body so that they are insulated from one another, and each of said electrodes which is connected to one and the same phase has a respective insulated lead connecting same to said source of electrical power.

7. An electric arc furnace as defined in claim 1, wherein all of said arc electrodes are disposed of the same distance from said vertical axis at said furnace body.

8. An electric arc furnace as defined in claims 1 or 7 wherein said furnace body has a circular cross section.

* * * * *